US012796885B2

(12) United States Patent
Temple et al.

(10) Patent No.: US 12,796,885 B2
(45) Date of Patent: Nov. 17, 2026

(54) SQUEEGEE WITH SWIVELING HEAD

(71) Applicant: Unger Marketing International, LLC, Bridgeport, CT (US)

(72) Inventors: Brandon M. Temple, Stamford, CT (US); Stephen P. Huda, Shelton, CT (US); James M. Buckley, New Hartford, CT (US)

(73) Assignee: Unger Marketing International, LLC, Bridgeport, CT (US)

( * ) Notice: Subject to any disclaimer, the term of this patent is extended or adjusted under 35 U.S.C. 154(b) by 311 days.

(21) Appl. No.: 18/404,053

(22) Filed: Jan. 4, 2024

(65) Prior Publication Data

US 2024/0225406 A1 Jul. 11, 2024

Related U.S. Application Data

(60) Provisional application No. 63/479,289, filed on Jan. 10, 2023.

(51) Int. Cl.
*A47L 13/11* (2006.01)

(52) U.S. Cl.
CPC ..... *A47L 13/11* (2013.01)

(58) Field of Classification Search
CPC ..... A47L 13/11; A47L 13/10
See application file for complete search history.

(56) References Cited

U.S. PATENT DOCUMENTS 1,360,615 A 11/1920 Bolard
1,694,636 A 12/1928 Barker
1,977,180 A 10/1934 Forbes
1,982,910 A 12/1934 Forbes et al.
2,140,706 A 12/1938 Latshaw
D118,714 S 1/1940 Rude
2,372,954 A 4/1945 Jester
D167,432 S 8/1952 Turner
2,637,537 A 5/1953 Arthur
2,707,300 A 5/1955 Angelillo
D186,902 S 12/1959 Fried
(Continued)

FOREIGN PATENT DOCUMENTS

CA 2519035 A1 10/2006
CA 2743814 A1 9/2011
(Continued)

OTHER PUBLICATIONS

Amazon, Unger Professional Grip Swivel Window and Glass Squeegee, 18". Retrieved online at: https://www.amazon.com/Unger-Professional-Grip-Swivel-Squeegee/dp/B01G5WNQB6?ref_=ast_sto_dp&th=1. 9 pages, (2024).
(Continued)

*Primary Examiner* — Shay Karls
(74) *Attorney, Agent, or Firm* — McCarter & English LLP

(57) ABSTRACT

A surface cleaning tool includes a handle body having a first longitudinal axis and a head configured to receive a wiper blade. A plane extending through a center of the head, parallel to the wiper blade, includes a second longitudinal axis of the head. The head is movable along a path of movement relative to the handle body. An orientation of the plane of the head remains constant relative to the longitudinal axis as the head moves along the path of movement.

18 Claims, 15 Drawing Sheets

(56) References Cited

U.S. PATENT DOCUMENTS 2,998,614 A 9/1961 Winch
3,058,139 A 10/1962 Dryden
3,332,103 A 7/1967 Case
3,407,424 A 10/1968 Lanzarone et al.
3,411,723 A 11/1968 Kohn
D258,486 S 3/1981 Wallace et al.
4,328,604 A 5/1982 Adams
D274,565 S 7/1984 Smith et al.
4,520,526 A 6/1985 Peters
D281,991 S 12/1985 Solheim
D296,271 S 6/1988 Kobayashi
D298,072 S 10/1988 Stirling
4,794,663 A 1/1989 Vosbikian
4,829,621 A 5/1989 Phenegar
4,847,938 A * 7/1989 Unger ..... A47L 1/06 15/245
5,158,532 A 10/1992 Peng et al.
5,231,322 A 7/1993 Richards et al.
5,315,732 A 5/1994 Huefner et al.
5,333,345 A 8/1994 O'Donnell
5,339,480 A 8/1994 Murg et al.
5,400,457 A 3/1995 Ridgley
5,418,999 A 5/1995 Smith
D363,340 S 10/1995 Varga
D364,015 S 11/1995 Stoltzfus
5,491,863 A 2/1996 Dunn
5,598,596 A 2/1997 Jones et al.
5,630,244 A 5/1997 Chang
D385,946 S 11/1997 Harrison et al.
5,709,003 A 1/1998 Batch
D394,923 S 6/1998 Hellinger et al.
D396,910 S 8/1998 Henke
D404,114 S 1/1999 Denkewicz, Jr. et al.
5,878,459 A 3/1999 McParland
D415,325 S 10/1999 Hellinger et al.
5,967,152 A 10/1999 Rimkus
6,015,293 A 1/2000 Rimkus
D423,790 S 5/2000 Solberg
6,132,126 A 10/2000 Sheffler et al.
6,134,738 A 10/2000 Weber et al.
6,154,913 A 12/2000 Burton
6,192,525 B1 2/2001 Tash
6,216,283 B1 4/2001 Tash
6,237,182 B1 5/2001 Cassar
D447,301 S 8/2001 Adair et al.
6,279,189 B1 8/2001 Cassar
D449,451 S 10/2001 Petner
D464,182 S 10/2002 Vosbikian
D469,259 S 1/2003 Vosbikian
6,530,707 B1 3/2003 Byrne et al.
6,546,588 B1 4/2003 Black
D479,024 S 8/2003 Libman
6,872,021 B1 3/2005 Wilson et al.
6,931,690 B2 8/2005 Cox
6,948,209 B2 9/2005 Chan
6,990,706 B2 1/2006 Broecker et al.
D515,758 S 2/2006 Turchi et al.
7,000,282 B2 2/2006 Cox et al.
7,017,222 B2 3/2006 Dunn
D518,949 S 4/2006 Wang
7,155,770 B2 1/2007 Anderson et al.
D542,493 S 5/2007 Berti
7,213,292 B1 5/2007 Tucker
7,334,286 B2 2/2008 Kayser
D564,161 S 3/2008 Talesfore et al.
7,343,638 B2 3/2008 Mitchell et al.
7,344,327 B2 3/2008 Gueret
7,356,869 B2 4/2008 Knopow et al.
D579,615 S 10/2008 Ames et al.
7,574,767 B2 8/2009 Michaels et al.
7,640,617 B2 1/2010 Kennedy et al.
7,716,777 B2 5/2010 Lee
7,740,193 B2 6/2010 Soller et al.
7,745,354 B2 6/2010 Tsuchiya et al.
7,748,074 B2 7/2010 Guizzi
7,784,141 B2 8/2010 Knopow et al.
D627,532 S 11/2010 Yang et al.
D632,857 S 2/2011 Sgroi et al.
D649,287 S 11/2011 Cho
D649,314 S 11/2011 Quinlan et al.
8,046,865 B2 11/2011 Knopow et al.
D652,593 S 1/2012 Wu
8,123,712 B2 2/2012 Julius
8,136,196 B2 3/2012 Dingert
D659,195 S 5/2012 Boltz et al.
D663,530 S 7/2012 Duwa
8,321,990 B2 12/2012 Lee
8,375,500 B1 2/2013 Aguirre
D683,544 S 6/2013 Duwa
8,677,549 B2 3/2014 Fields
8,719,990 B2 5/2014 Borofsky
8,726,451 B2 5/2014 Patterson et al.
8,763,193 B1 7/2014 Thompson et al.
D715,009 S 10/2014 Curien
8,904,589 B2 12/2014 Santarsiero et al.
8,984,701 B2 3/2015 Tussy
D726,196 S 4/2015 van Os
D730,060 S 5/2015 Rennette
9,066,583 B2 6/2015 Kayser
9,113,767 B1 8/2015 Hensel
9,167,882 B2 10/2015 Stefanson et al.
D745,299 S 12/2015 Chang
D749,919 S 2/2016 Cianciolo
9,297,170 B1 3/2016 Jones
D757,443 S 5/2016 Waitesmith
9,339,104 B2 5/2016 O'Neill
9,339,164 B2 5/2016 Santarsiero et al.
9,341,364 B2 5/2016 Dennis
D773,141 S 11/2016 Chitayat et al.
D773,799 S 12/2016 Haythornthwaite
9,532,694 B1 1/2017 Shippen et al.
D779,143 S 2/2017 Sgroi, Jr. et al.
D789,074 S 6/2017 Haythornthwaite
D796,440 S 9/2017 Gzybowski
D804,770 S 12/2017 Zoubovsky
9,855,927 B2 1/2018 Heine et al.
D830,553 S 10/2018 Wall
D835,916 S 12/2018 Macca et al.
D840,207 S 2/2019 Sun et al.
10,272,667 B2 4/2019 Hoffman, Jr. et al.
D851,408 S 6/2019 Harrington
D851,409 S 6/2019 Harrington
D851,410 S 6/2019 Harrington
D852,510 S 7/2019 Harrington et al.
10,357,138 B2 7/2019 Caruso
10,455,996 B1 10/2019 Khubani et al.
10,470,638 B2 11/2019 Patterson et al.
D869,915 S 12/2019 Seeuwen et al.
10,562,173 B2 2/2020 Stewart et al.
D882,963 S 5/2020 Harrington
10,640,093 B2 5/2020 Wood et al.
10,653,288 B2 5/2020 Batchelor, Jr. et al.
10,687,680 B1 6/2020 Even
10,765,290 B2 9/2020 Kalitowski
10,881,264 B2 1/2021 Patterson et al.
D909,069 S 2/2021 Harrington
11,006,738 B2 5/2021 Harrington et al.
11,019,974 B2 6/2021 Caruso
D942,154 S 2/2022 Harrington
D960,476 S 8/2022 Scimone et al.
11,458,515 B2 10/2022 Harrington
D998,272 S 9/2023 Liu
2001/0047556 A1 12/2001 Weihrauch
2002/0148061 A1 10/2002 Tanaka et al.
2003/0079278 A1 5/2003 Tash
2004/0011382 A1 1/2004 Kingry et al.
2004/0025235 A1 2/2004 Tash
2004/0060577 A1 4/2004 Dunn
2004/0143923 A1 7/2004 Bensussan et al.
2004/0177863 A1 9/2004 McKay
2005/0144749 A1 7/2005 Yamada
2005/0158116 A1 7/2005 Belansky et al.
2005/0283933 A1 12/2005 Mitchell et al.
2006/0070198 A1 4/2006 DeRoma

(56) References Cited

U.S. PATENT DOCUMENTS

| | | | | |
|---|---|---|---|---|
| 2006/0234899 | A1 | 10/2006 | Nekmard et al. | |
| 2007/0020020 | A1 | 1/2007 | Bobrosky et al. | |
| 2007/0028409 | A1 | 2/2007 | Yamada | |
| 2007/0044264 | A1 | 3/2007 | Argo et al. | |
| 2007/0274762 | A1 | 11/2007 | Edwards et al. | |
| 2008/0028555 | A1 | 2/2008 | Petner et al. | |
| 2008/0028560 | A1 | 2/2008 | Policicchio et al. | |
| 2008/0032577 | A1 | 2/2008 | Policicchio et al. | |
| 2010/0115722 | A1 | 5/2010 | Malloy | |
| 2011/0107551 | A1 | 5/2011 | Cassar | |
| 2011/0167583 | A1* | 7/2011 | Weaver | A47L 13/256 15/231 |
| 2011/0225756 | A1 | 9/2011 | Chapman et al. | |
| 2011/0226638 | A1 | 9/2011 | Hoadley et al. | |
| 2012/0183344 | A1 | 7/2012 | Habinger | |
| 2013/0298342 | A1 | 11/2013 | Cassar | |
| 2014/0099154 | A1 | 4/2014 | O'Neill | |
| 2014/0137352 | A1 | 5/2014 | Golla et al. | |
| 2016/0011380 | A1 | 1/2016 | Tourigny | |
| 2016/0029859 | A1 | 2/2016 | Harrington et al. | |
| 2016/0249733 | A1 | 9/2016 | Tebbe et al. | |
| 2016/0259131 | A1 | 9/2016 | Erdman et al. | |
| 2017/0119125 | A1 | 5/2017 | Davis | |
| 2017/0208928 | A1 | 7/2017 | Birkert et al. | |
| 2018/0084896 | A1 | 3/2018 | Redford et al. | |
| 2018/0156984 | A1 | 6/2018 | Achkir | |
| 2018/0206693 | A1 | 7/2018 | Harrington et al. | |
| 2018/0221924 | A1 | 8/2018 | Harrington | |
| 2019/0343364 | A1 | 11/2019 | Nadeau | |
| 2020/0253433 | A1 | 8/2020 | Bussell | |
| 2021/0016429 | A1 | 1/2021 | Savard | |
| 2021/0227961 | A1 | 7/2021 | Harrington et al. | |
| 2022/0218173 | A1* | 7/2022 | Vernazza | B25G 3/38 |
| 2022/0410224 | A1 | 12/2022 | Harrington | |

FOREIGN PATENT DOCUMENTS

| | | | |
|---|---|---|---|
| CN | 306783811 | | 8/2021 |
| DE | 1986144 | U | 5/1968 |
| DE | 1995617 | U | 10/1968 |
| DE | 4435888 | A1 | 4/1996 |
| DE | 202013005066 | U1 | 8/2013 |
| EP | 1609565 | A1 | 12/2005 |
| EP | 1662958 | A1 | 6/2006 |
| EP | 2189093 | A2 | 5/2010 |
| EP | 2430964 | A2 | 3/2012 |
| EP | 3015039 | A1 | 5/2016 |
| EP | 3512400 | A1 | 7/2019 |
| EP | 3801166 | A1 | 4/2021 |
| FR | 2371178 | A1 | 6/1978 |
| GB | 418871 | A | 11/1934 |
| GB | 651508 | A | 4/1951 |
| JP | 62-246345 | A | 10/1987 |
| JP | 2-57904 | | 10/1990 |
| NZ | 409239-0001 | S | 10/2007 |
| WO | WO-2013/063568 | A1 | 5/2013 |
| WO | WO-2019/236910 | A1 | 12/2019 |
| WO | WO-2019/241894 | A1 | 12/2019 |
| WO | WO-2019/243459 | A1 | 12/2019 |
| WO | WO-2020/170146 | A1 | 8/2020 |

OTHER PUBLICATIONS

U.S. Appl. No. 15/879,373, filed Jan. 24, 2018, U.S. Pat. No. 11,006,738, Issued.

U.S. Appl. No. 17/232,850, filed Apr. 16, 2021, 2021-0227961, Published.

U.S. Appl. No. 15/879,378, filed Jan. 24, 2018, U.S. Pat. No. 11,458,515, Issued.

U.S. Appl. No. 17/939,526, filed Sep. 7, 2022, 2022-0410224, Published.

U.S. Appl. No. 29/634,782, filed Jan. 24, 2018, U.S. Pat. No. D. 851,408, Issued.

U.S. Appl. No. 29/634,783, filed Jan. 24, 2018, U.S. Pat. No. D. 851,409, Issued.

U.S. Appl. No. 29/634,784, filed Jan. 24, 2018, U.S. Pat. No. D. 851,410, Issued.

U.S. Appl. No. 29/634,786, filed Jan. 24, 2018, U.S. Pat. No. D. 852,510, Issued.

U.S. Appl. No. 29/657,583, filed Jul. 24, 2018, U.S. Pat. No. D. 882,963, Issued.

U.S. Appl. No. 29/730,385, filed Apr. 3, 2020, U.S. Pat. No. D. 909,069, Issued.

U.S. Appl. No. 29/761,768, filed Dec. 11, 2020, D. 942,154, Issued.

U.S. Appl. No. 29/870,558, filed Jan. 30, 2023, Pending.

* cited by examiner

SQUEEGEE WITH SWIVELING HEAD

CROSS-REFERENCE TO RELATED APPLICATIONS

The present application is a nonprovisional application and claims priority to U.S. Provisional Application Ser. No. 63/479,289 filed on Jan. 10, 2023, the contents of all of which are incorporated by reference herein in their entirety.

BACKGROUND

Exemplary embodiments of the disclosure relate to a surface cleaning tool for hard surfaces, and more particularly, to a surface cleaning tool having an adjustable configuration.

Surface cleaning tools, such as squeegee devices, typically include a handle having a cleaning implement, such as a wiper or squeegee blade secured thereto. Many such devices have been developed for use with floors or large flat surfaces. Here, the handle is then used in a known manner to move the blade along a floor, driveway, walkway, or any other substantially flat surface to push liquid and/or solid debris to a desired location. The cleaning implement of existing tools is typically fixedly positioned relative to the handle, thereby limiting the ease of access by a user to non-uniformly shaped or difficult to reach areas.

Accordingly, while existing squeegee devices are suitable for their intended purposes the need for improvement remains, particularly in providing a squeegee having the features described herein.

BRIEF DESCRIPTION

According to an embodiment, a surface cleaning tool includes a handle body having a first longitudinal axis and a head configured to receive a wiper blade. A plane extending through a center of the head, parallel to the wiper blade, includes a second longitudinal axis of the head. The head is movable along a path of movement relative to the handle body. An orientation of the plane of the head remains constant relative to the longitudinal axis as the head moves along the path of movement.

In addition to one or more of the features described above, or as an alternative, in further embodiments the head is positionable at a plurality of positions relative to the handle body.

In addition to one or more of the features described above, or as an alternative, in further embodiments the head is rotatable relative to the handle body between the plurality of positions.

In addition to one or more of the features described above, or as an alternative, in further embodiments the plurality of positions includes a first position and a second position. In the first position, the second longitudinal axis is arranged at a first angle relative to the first longitudinal axis and in the second position, the second longitudinal axis is arranged at a second angle relative to the first longitudinal axis.

In addition to one or more of the features described above, or as an alternative, in further embodiments the first angle is equal and opposite to the second angle.

In addition to one or more of the features described above, or as an alternative, in further embodiments at least one position of the plurality of positions is located between the first position and the second position along the path of movement.

In addition to one or more of the features described above, or as an alternative, in further embodiments the plurality of positions includes a third position and in the third position, the second longitudinal axis is aligned with the first longitudinal axis.

In addition to one or more of the features described above, or as an alternative, in further embodiments the surface cleaning tool includes a locking mechanism operable to retain the head in one of the plurality of positions.

In addition to one or more of the features described above, or as an alternative, in further embodiments the locking mechanism includes an engagement mechanism movable between an unlocked position and a locked position. The head is movable between the plurality of positions when the engagement mechanism is in the unlocked position and the head is restricted from moving between the plurality of positions when the engagement mechanism is in the locked position.

In addition to one or more of the features described above, or as an alternative, in further embodiments the head includes a plurality of slots and in the locked position, a portion of the engagement mechanism is positionable within one of the plurality of slots.

According to an embodiment, a surface cleaning tool includes a handle body and a head connected to the handle body and configured to receive a wiper blade. The head is movable along a path of movement relative to the handle body. The head includes a plurality of protrusions and a plurality of slots formed between the plurality of protrusions. A locking mechanism is operable to selectively lock the head relative to the handle body. The locking mechanism includes an engagement mechanism having an engagement feature positioned adjacent to a surface of the head. The engagement feature is receivable within one of the plurality of slots to restrict movement of the head along the path of movement.

In addition to one or more of the features described above, or as an alternative, in further embodiments the engagement mechanism is manually movable to selectively lock the head relative to the handle body.

In addition to one or more of the features described above, or as an alternative, in further embodiments the engagement mechanism is translatable between an unlocked position and a locked position. The engagement feature is receivable within one of the plurality of slots in the locked position.

In addition to one or more of the features described above, or as an alternative, in further embodiments each of the plurality of slots is associated with a different position of the head along the path of movement.

In addition to one or more of the features described above, or as an alternative, in further embodiments the head is movable within a plane oriented parallel to the wiper blade and including a longitudinal axis of the head.

In addition to one or more of the features described above, or as an alternative, in further embodiments the plane is arranged at an angle to a longitudinal axis of the handle body.

In addition to one or more of the features described above, or as an alternative, in further embodiments the longitudinal axis of the head is coplanar with a longitudinal axis of the handle body.

In addition to one or more of the features described above, or as an alternative, in further embodiments the head is rotatable about an axis along the path of movement.

In addition to one or more of the features described above, or as an alternative, in further embodiments the axis is arranged at an angle to a longitudinal axis of the handle body.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
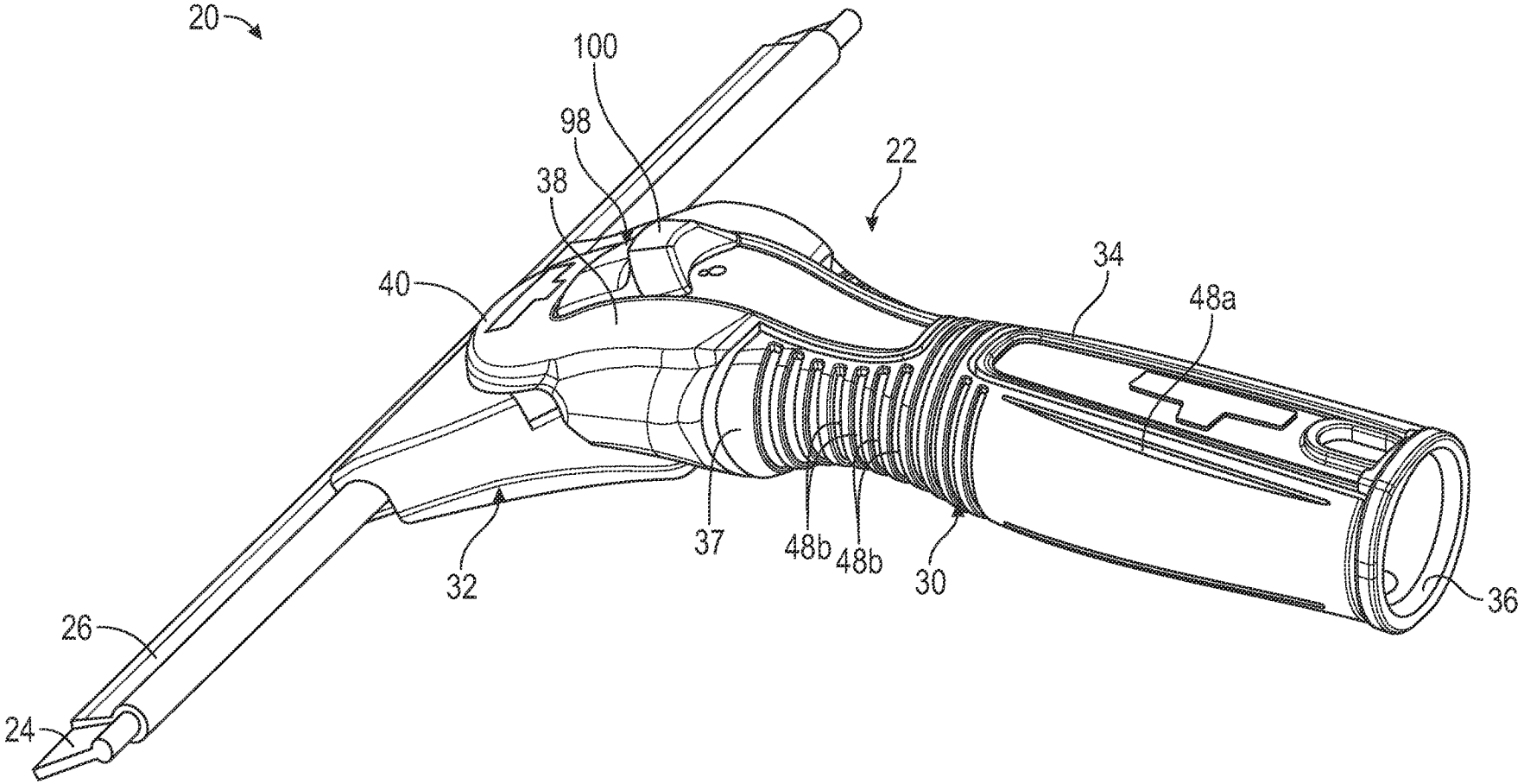
FIG. 1 is a perspective view of a surface cleaning tool according to an embodiment.
Figure 2B:
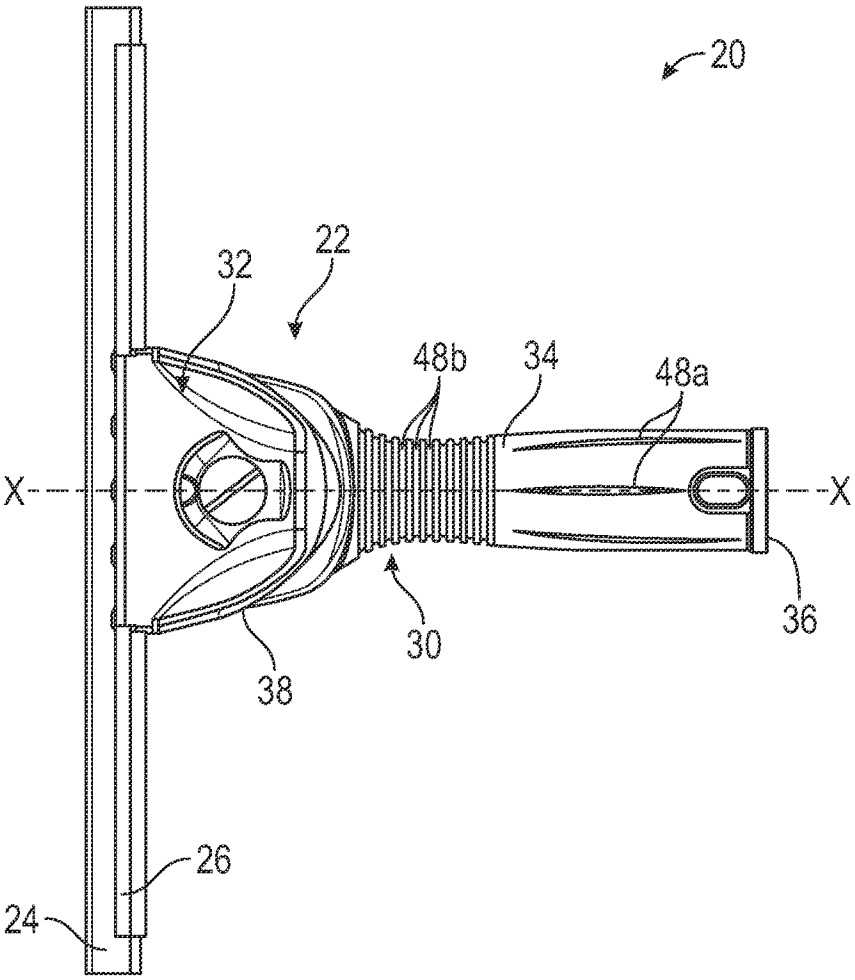
FIG. 2B is a bottom plan view of the surface cleaning tool of FIG. 1 according to an embodiment.
Figure 2A:
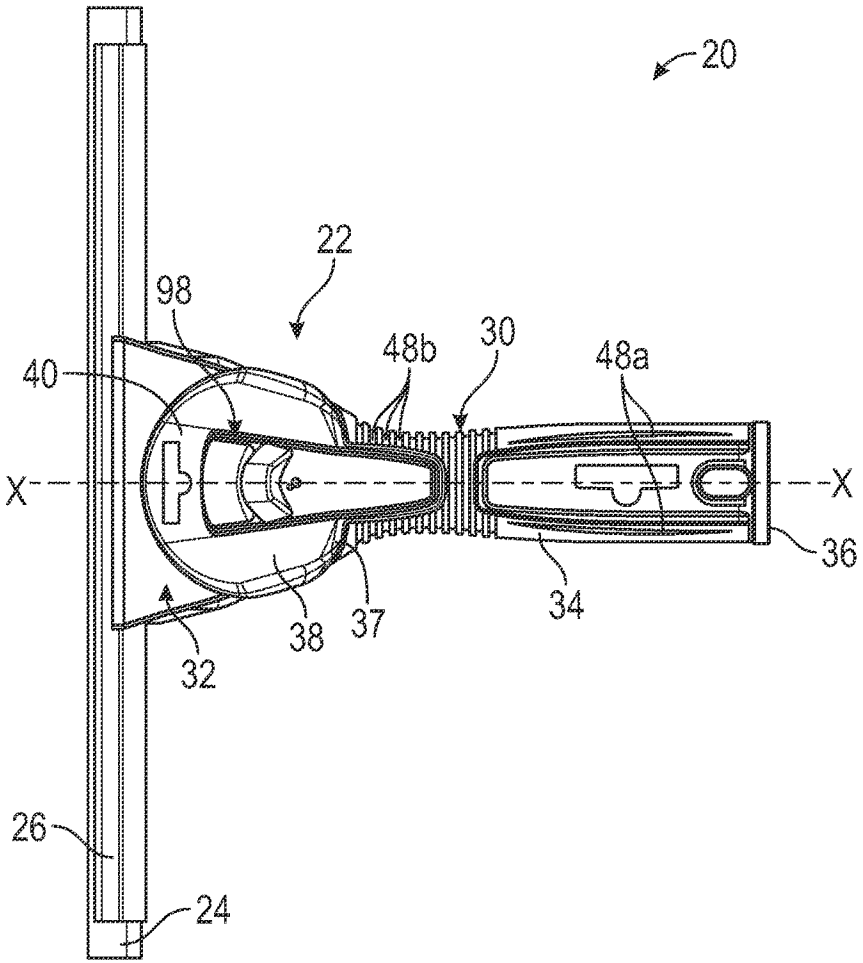
FIG. 2A is a plan view of the surface cleaning tool of FIG. 1 according to an embodiment.
Figure 3:
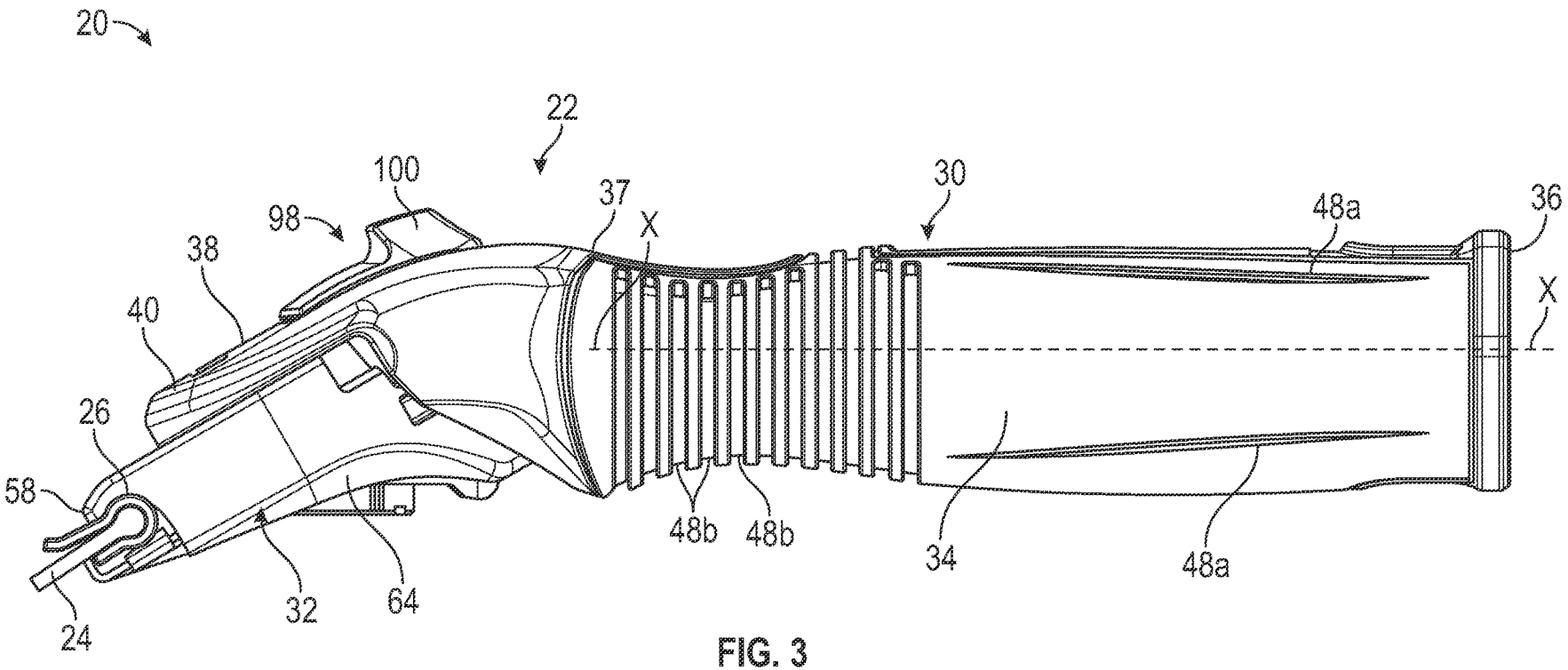
FIG. 3 is a side view of the surface cleaning tool of FIG. 1 according to an embodiment.
Figure 4A:
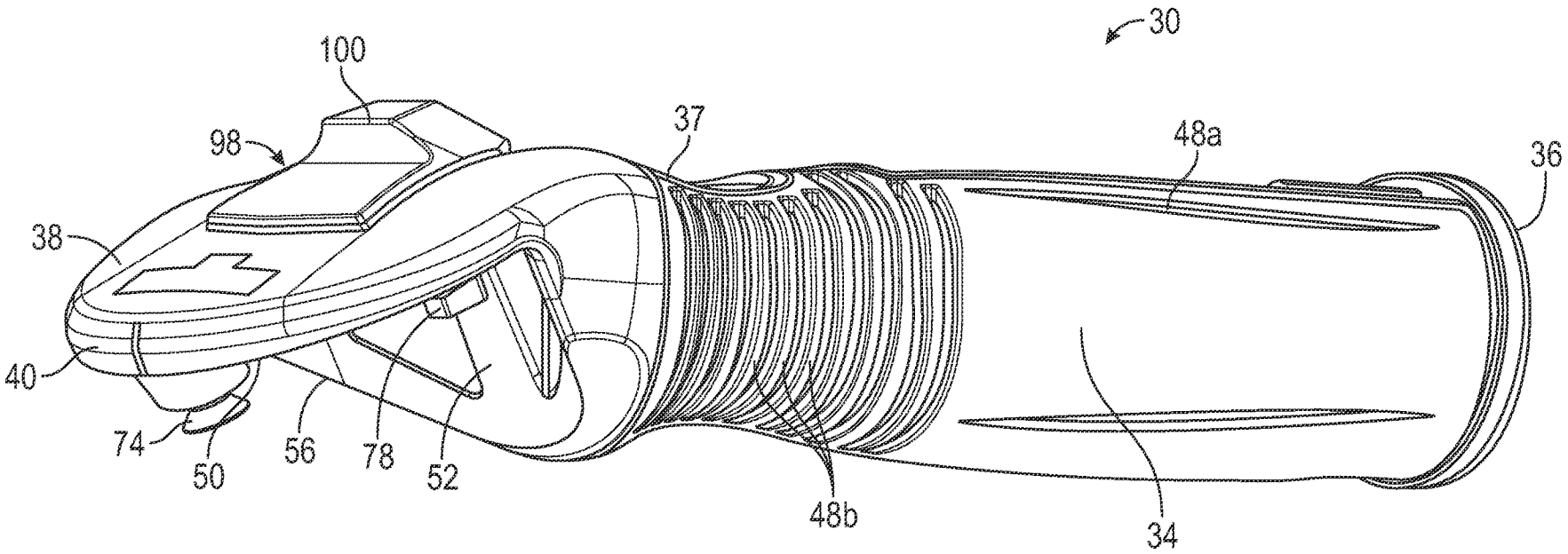
FIG. 4A is a perspective view of the handle body of the handle assembly of the surface cleaning tool of FIG. 1 according to an embodiment.
Figure 4B:
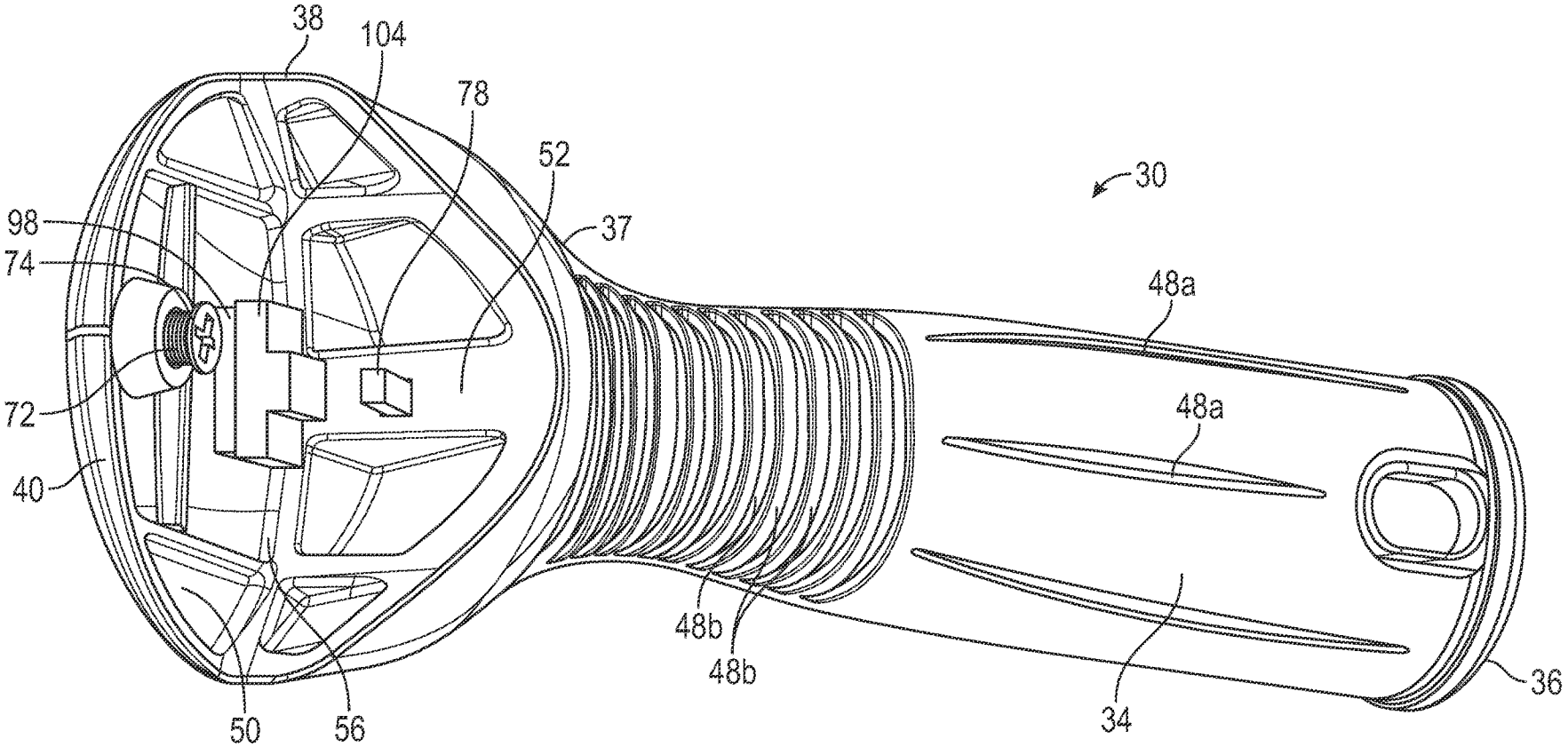
FIG. 4B is another perspective view of the handle body of the handle assembly of the surface cleaning tool of FIG. 1 according to an embodiment.
Figure 5A:
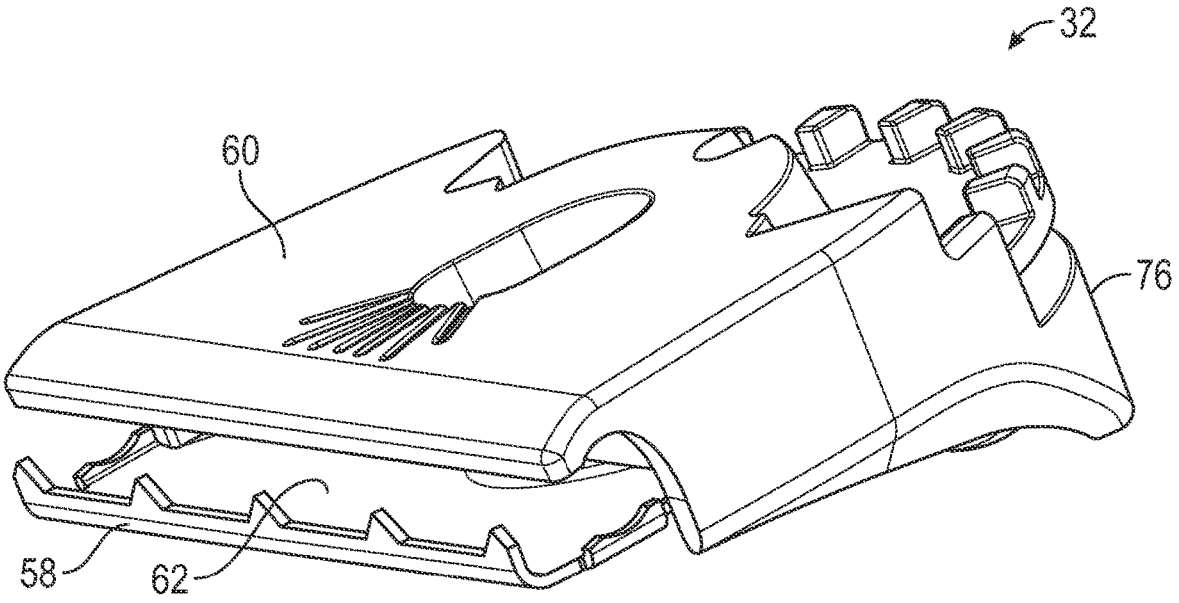
FIG. 5A is a perspective view of a head of the handle assembly of the surface cleaning tool of FIG. 1 according to an embodiment.
Figure 5B:
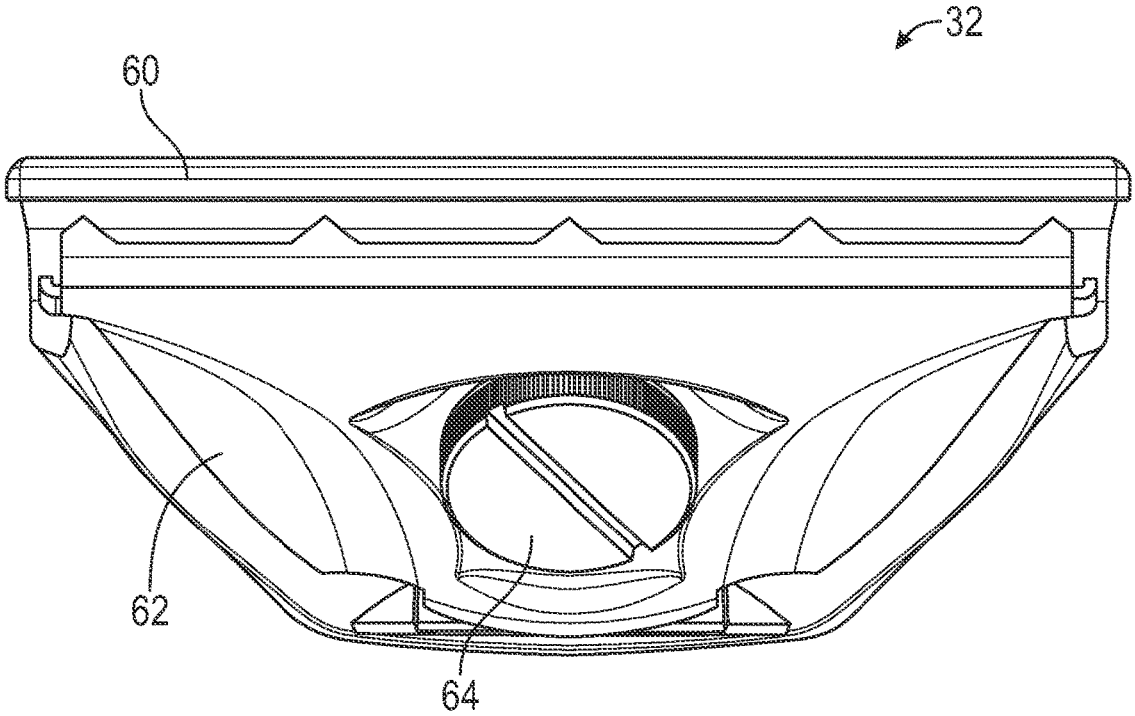
FIG. 5B is another perspective view of a head of the handle assembly of the surface cleaning tool of FIG. 1 according to an embodiment.
Figure 5C:
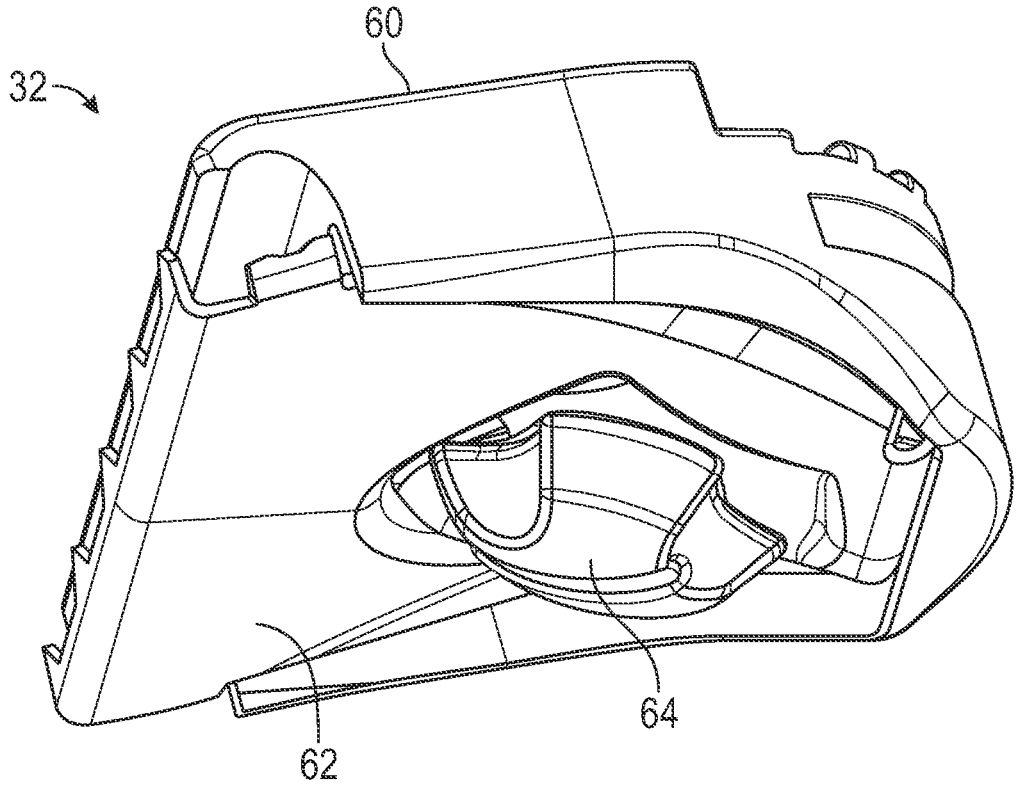
FIG. 5C is a perspective view of another head of the handle assembly of the surface cleaning tool of FIG. 1 according to an embodiment.

A detailed description of one or more embodiments of the disclosed apparatus and method are presented herein by way of exemplification and not limitation with reference to the Figures.

With reference to the Figures, an example of a surface cleaning tool according to an embodiment is illustrated at 20. The surface cleaning tool 20 includes a handle assembly 22, a cleaning implement 24, such as a wiper blade for example, and a channel 26 for mounting the cleaning implement 24 to the handle assembly 22.

The cleaning implement or wiper blade 24 may be formed from a natural or synthetic material that is sufficiently rigid to allow the wiper blade to function, yet flexible and soft enough to prevent the wiper blade 24 from scratching the surface being cleaned. Examples of suitable materials of the wiper blade 24 include, but are not limited to, polyolefin plastic, any deformable plastic, synthetic rubber, natural rubber, an elastomer, a foam material including elastomeric or other deformable polymeric foams and the like.

The channel 26 has a generally hollow interior (not shown) within which the wiper blade 24 is removably receivable. The channel 26 may also be made of any material suitable to withstand the forces exerted during normal operation of the surface cleaning tool 20 and to withstand the cleaning chemicals normally associated with the use of such tools. For example, the channel 26 can be made of materials including, but not limited to, molded polymeric material, die cast metallic materials, formed metallic materials, and extruded polymeric or metallic materials.

With further reference to FIGS. 3-6, the handle assembly 22 is illustrated in more detail. As shown, the handle assembly 22 includes a handle body 30 (FIGS. 4A-4B) and a head 32 (FIGS. 5A and 5B) mounted to the handle body 30. In the illustrated, non-limiting embodiment, the handle body 30 has a handle portion 34 located adjacent to a first end 36 thereof and a connector portion 38 arranged adjacent to a second, opposite end 40 thereof. The handle portion 34 of the handle body 30 is generally elongate and may be cylindrical in shape. Although the outer diameter of the handle portion 34 is illustrated as varying over the axial length thereof (the outer diameter gradually decreases and then increases toward the connector portion of the body), embodiments where the outer diameter is substantially constant are also contemplated herein.

Figure 6:
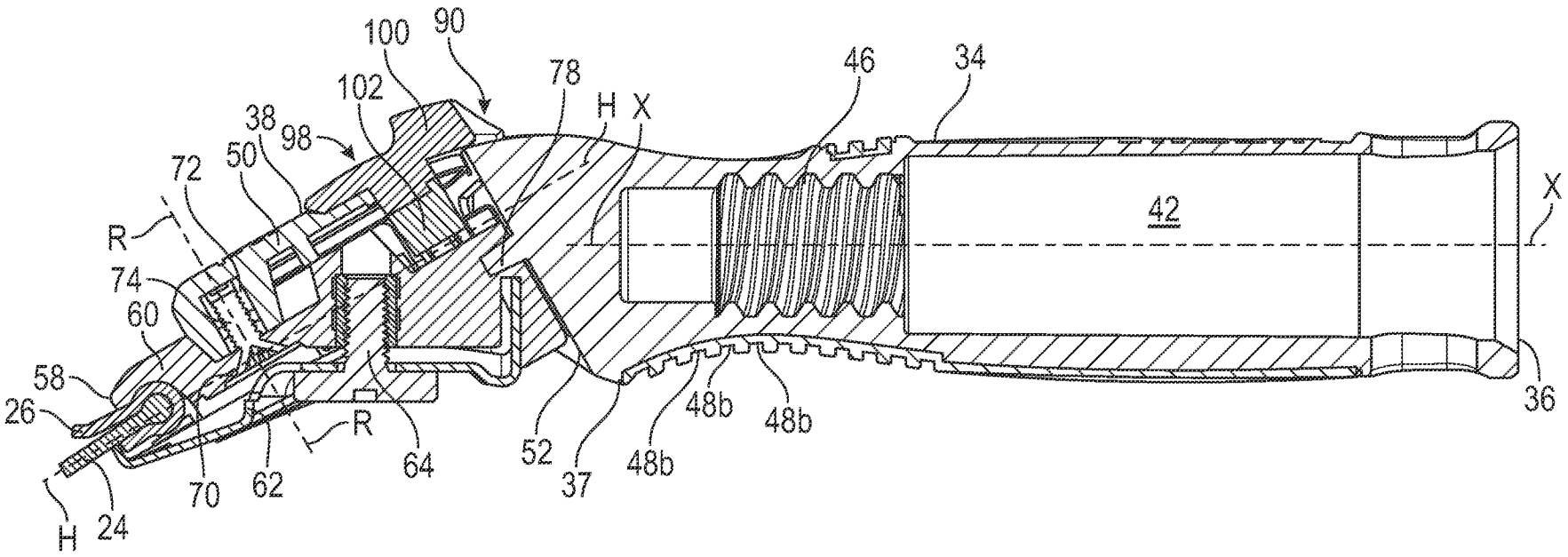
FIG. 6 is a cross-sectional view of the surface cleaning tool of FIG. 1 according to an embodiment.

As best shown in FIG. 6, an opening 42 may be formed at the first end 36 of the handle body 30. The opening 42 may extend over only a portion, or alternatively, over the entirety of the axial length of the handle body 30. In an embodiment, the opening 42 is sized to receive the end of a pole or other component (not shown) therein to allow for use of the surface cleaning tool 20 in an extended configuration. To removably mount the surface cleaning tool 20 to the end of the pole, the handle assembly 22 includes at least a portion of a coupling mechanism 46. For example, a portion of a coupling mechanism 46 may be arranged or formed within the opening 42. In the illustrated, non-limiting embodiment, the coupling mechanism 46 includes a plurality of threads configured to mate with a corresponding plurality of threads (not shown) formed about a portion of the pole receivable within the opening 42; however, other suitable coupling mechanisms 46, such as a snap-fit connection for example, are also contemplated herein. Further, in other embodiments, a coupling mechanism 46, such as a fastener for example, may extend through another opening formed in the handle body 30 to couple the pole to the handle body 30.

One or more gripping features may be formed at the outer surface of the handle portion 34. These gripping features may be strategically positioned and designed to facilitate a user's grasp about the handle portion 34. For example, a first type of gripping feature may include at least one elongate rib 48*a* extending generally parallel to the longitudinal axis X of the handle portion 34. In the illustrated, non-limiting embodiment, a plurality of elongate ribs 48*a* are spaced about a periphery of the handle portion 34 of the handle body 30. Alternatively, or additionally, a second type of gripping feature may include at least one groove 48*b*, such as arranged within a plane oriented generally perpendicular to the longitudinal axis X for example, such that the groove 48*b* wraps about at least a portion, and in some embodiment an entirety, of the periphery of the handle portion 34. In an embodiment, a plurality of grooves 48*b* are spaced along the longitudinal axis X of the handle portion 34, such as at the region adjacent to the connector portion 38, where the outer diameter of the handle portion 34 may vary. It should be appreciated that the gripping features illustrated and described herein are intended as an example only and that a gripping feature having any suitable configuration is within the scope of the disclosure. Furthermore, embodiments where the handle portion 34 does not include any gripping features are also within the scope of the disclosure.

The connector portion 38 of the handle body 30 may be integrally formed with an end 37 of the handle portion 34 of the handle body 30. In an embodiment, both the connector portion 38 and the handle portion 34 are formed from a first material, such as a plastic material. Further, the handle portion 34 may be over molded with a second material, different or identical to the first material, to form the one or more gripping features.

As shown, the connector portion 38 of the handle body 30 has a generally circular shape (in plan view). However, embodiments where the connector portion 38 has another shape are also contemplated herein. In the illustrated, non-limiting embodiment, the connector portion 38 generally includes only an upper wall 50 and a rear wall 52 extending at an angle from the upper wall 50, such as near the end 54 of the upper wall 50 adjacent to the handle portion 34. In other embodiments, the connector portion 38 may alternatively or additionally include a bottom wall (not shown) extending from the rear wall 52 generally parallel to the upper wall 50. In such embodiments, the bottom wall may, but need not have a similar configuration to that of the upper wall 50.

The head 32 of the handle assembly 22 is permanently or removably coupled to the connector portion 38 of the handle body 30. A cavity 56 is generally formed between the upper wall 50 and the rear wall 52, and when included, the bottom wall, and in an embodiment, at least a portion of the head 32 of the handle assembly 22 is receivable within the cavity 56. As shown, when the head 32 is connected to the handle body 30, a distal end 58 of the head 32 may protrude or extend beyond the connector portion 38. As shown, the head 32 is oriented such that a second longitudinal axis H of the head 32 is arranged at an angle relative to the first longitudinal axis X of the handle portion 34. However, in other embodiments, the longitudinal axis H of the head 32 and the longitudinal axis X of the handle portion 34 may be coaxial or parallel to one another.

In an embodiment, the head 32 includes a housing assembly including an upper housing 60 and a lower housing 62. The upper and lower housing 58, 60 may be removably connected to one another, via a fastener, such as a knob or thumbscrew for example. Although the lower housing 62 is illustrated as being movably mounted to the upper housing 60 via a rotatable fastener 64, it should be understood that any suitable mechanism for movably coupling the upper and lower housings 60, 62 is contemplated herein.

As shown in the FIGURES, the channel 26 is connectable to the distal end 58 of the head 32. In an embodiment, the channel 26 is positionable within a clearance formed between the upper housing 60 and the lower housing 62. The clamping pressure applied by the upper and lower housing 60, 62 (controlled by the fastener 64 or other connector) to the channel 26 is sufficient to restrict separation of the channel 26 from the head 32. When mounted to the head 32, the channel 26 extends generally parallel to the distal end 58 of the head 32.

In an embodiment, when the head 32 is connected to the handle body 30, the head 32, and therefore the channel 26 and wiper blade 24 connectable to the head 32, is movable relative to the handle body 30. For example, the head 32 may be generally rotatable about an axis R (FIG. 6) arranged at a non-parallel angle to the longitudinal axis X of the handle portion 34. In an embodiment, the head 32 is configured to rotate within a plane extending through a center of the head 32, parallel to the length of the wiper blade 24, and containing the longitudinal axis H of the head 32. Accordingly, as the head 32 rotates about the axis R, the relative orientation of the plane of rotation of the head 32 and the longitudinal axis X of the handle portion 34 remains substantially constant.

In an embodiment, the head 32 is rotatable relative to the handle body 30 between a plurality of positions. It should be appreciated that each of the plurality of positions may correlate to a respective or distinct angle between the longitudinal axis H of the head 32 and the longitudinal axis X of the handle portion 34. For example, in a first position, the longitudinal axis H of the head 32 may be arranged at a first angle, such as a 45° angle for example, relative to the longitudinal axis X and in a second position, the longitudinal axis H of the head 32 may be oriented at a second angle, such as a −45° angle, relative to the longitudinal axis X. Because the wiper blade 24 and channel 26 are oriented generally substantially perpendicular to the longitudinal axis H of the head 32, in the first and second configurations, the wiper blade 24 is also arranged at a −45° angle or 45° angle relative to the longitudinal axis X. Although the first and second positions are illustrated and described as being equal but opposite angles, embodiments where the first angle when the head 32 is rotated in a first direction relative to the longitudinal axis X is different than the second angle when the head 32 is rotated in a second, opposite direction relative to the longitudinal axis X are also contemplated herein.

It should be appreciated that at least one position of the head 32 may be arranged between the first position and the second position, respectively, along the path of movement of the head 32. For example, the head 32 may be positionable at a third position where the longitudinal axis H of the head 32 is generally aligned or parallel with the longitudinal axis X, at a fourth position arranged between the first position and the third position, and at a fifth position arranged between the third position and the second position. In an embodiment, the plurality of positions of the head 32 includes seven distinct positions where the longitudinal axis H of the head 32 is arranged at 45°, 30°, 15°, 0°, −15°, −30°, and −45° relative to the longitudinal axis X of the handle portion 34, respectively. Alternatively, it should be appreciated that the head 32 may be arranged at any suitable position along the path of movement between the first position and the second position to achieve varying degrees of angle of the head 32.

With continued reference to FIG. 6 and further reference to FIG. 7A-9, an example of the rotatable connection between the head 32 and the connector portion 38 is illustrated in more detail. In the illustrated, non-limiting embodiment, a through hole 70 formed the upper housing 60 of the head 32 is aligned with an opening 72 formed in the upper wall 50 of the connector portion 38. A fastener 74, such as a screw for example, is receivable within the aligned through hole 70 and opening 72 to couple the head 32 to the handle body 30. In an embodiment, the axis of the through hole 70, opening 72, and fastener 74, is the axis of rotation R of the head 32.

As shown, a back side 76 of the upper housing 60 may have a generally arcuate contour complementary to the rear wall 52 of the connector portion 38. In an embodiment, a tab 78 protruding from the rear wall 52 of the connector portion 38 is receivable within a generally elongated slot or groove 80 formed in the surface of the back side 76. The groove 80 (see FIG. 7B) may be designed such that the tab 78 remains within the groove 80 over the entire path of movement of the head 32. For example, the tab 78 may be arranged adjacent to a first side 82 of the groove 80 when the head 32 is in the first position and the tab 78 may be arranged adjacent to a second, opposite side 84 of the groove 80 when the head 32 is in the second position.

Figure 7A:
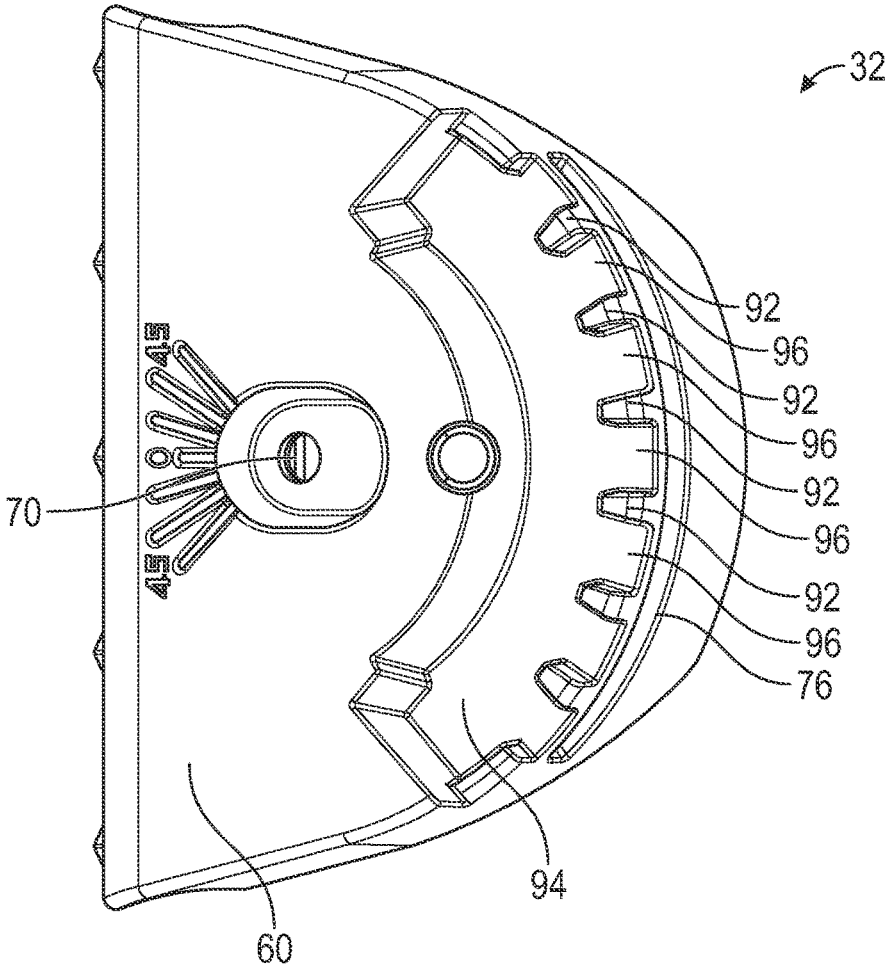
FIG. 7A is a top view of the head of the handle assembly of the surface cleaning tool of FIG. 1 according to an embodiment.
Figure 7B:
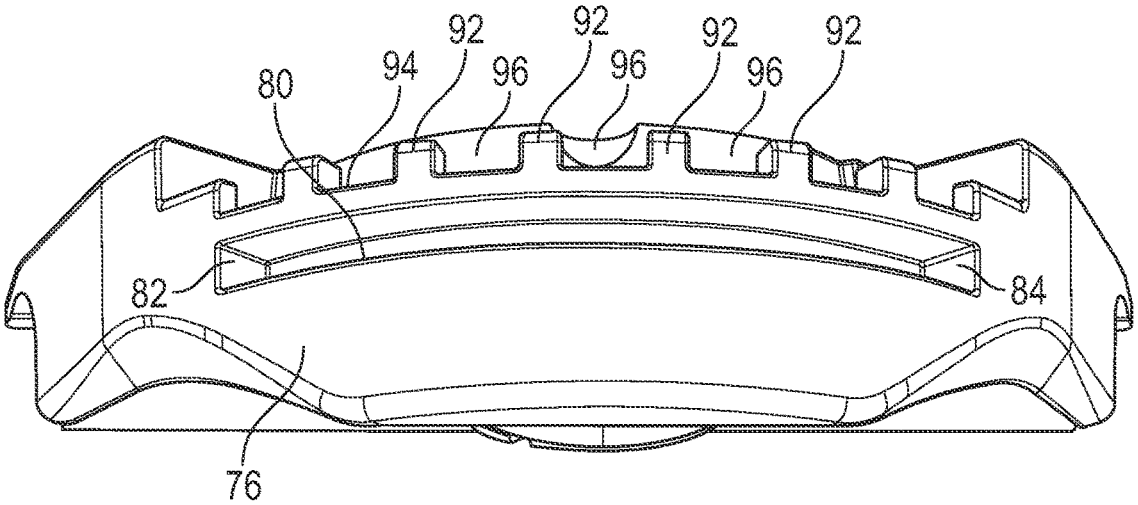
FIG. 7B is a rear perspective view of the head of the handle assembly of the surface cleaning tool of FIG. 1 according to an embodiment.
Figure 8A:
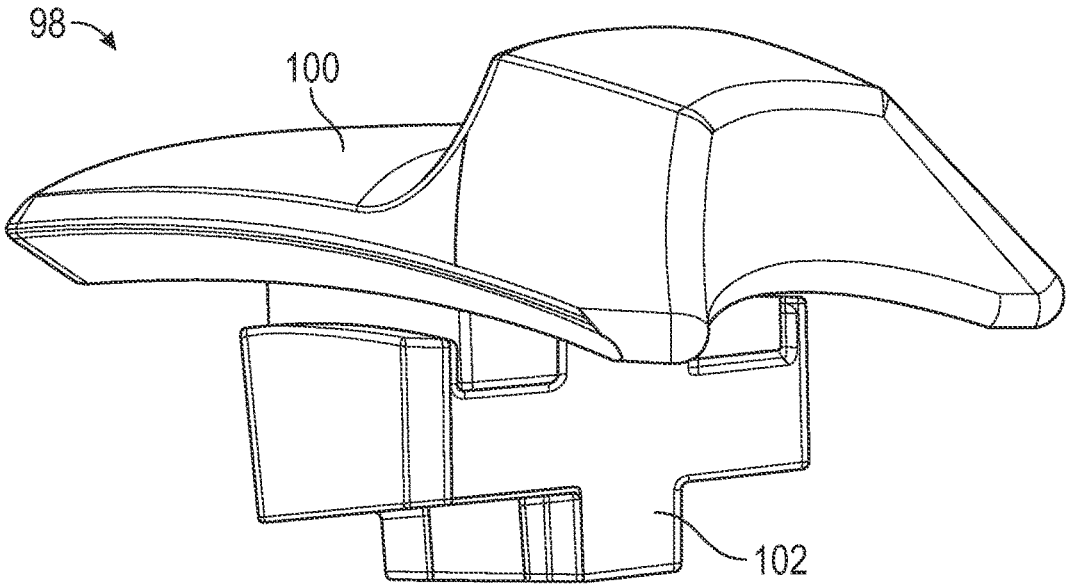
FIG. 8A is a perspective view of an engagement mechanism of the surface cleaning tool of FIG. 1 according to an embodiment.
Figure 8B:
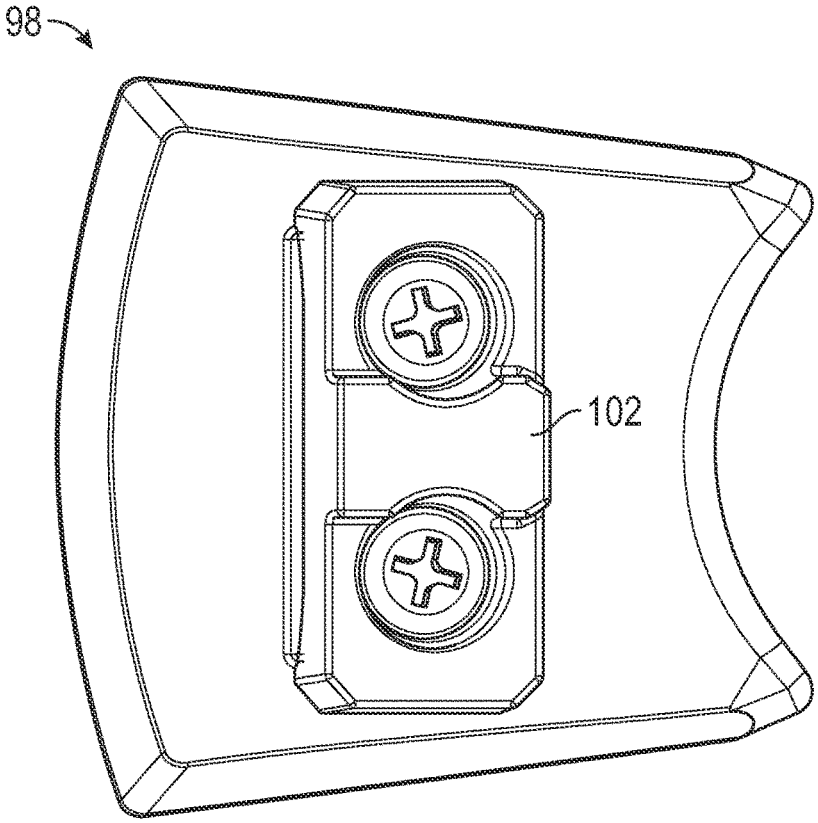
FIG. 8B is a bottom perspective view of an engagement mechanism of the surface cleaning tool of FIG. 1 according to an embodiment.
Figure 9:
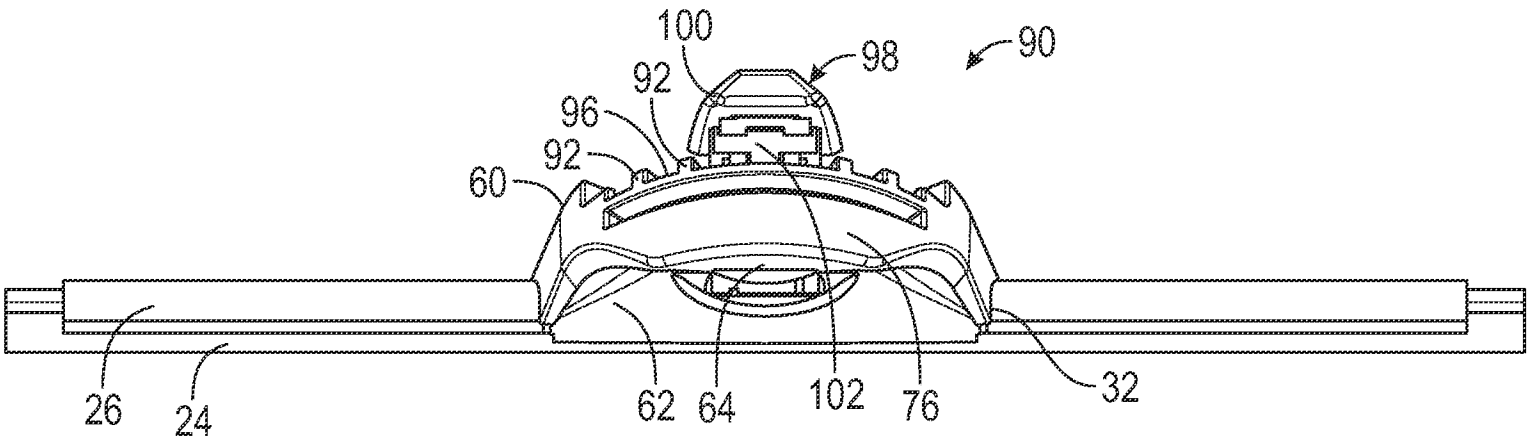
FIG. 9 is a rear perspective view of the engagement between the engagement mechanism and the head according to an embodiment.
Figure 10:
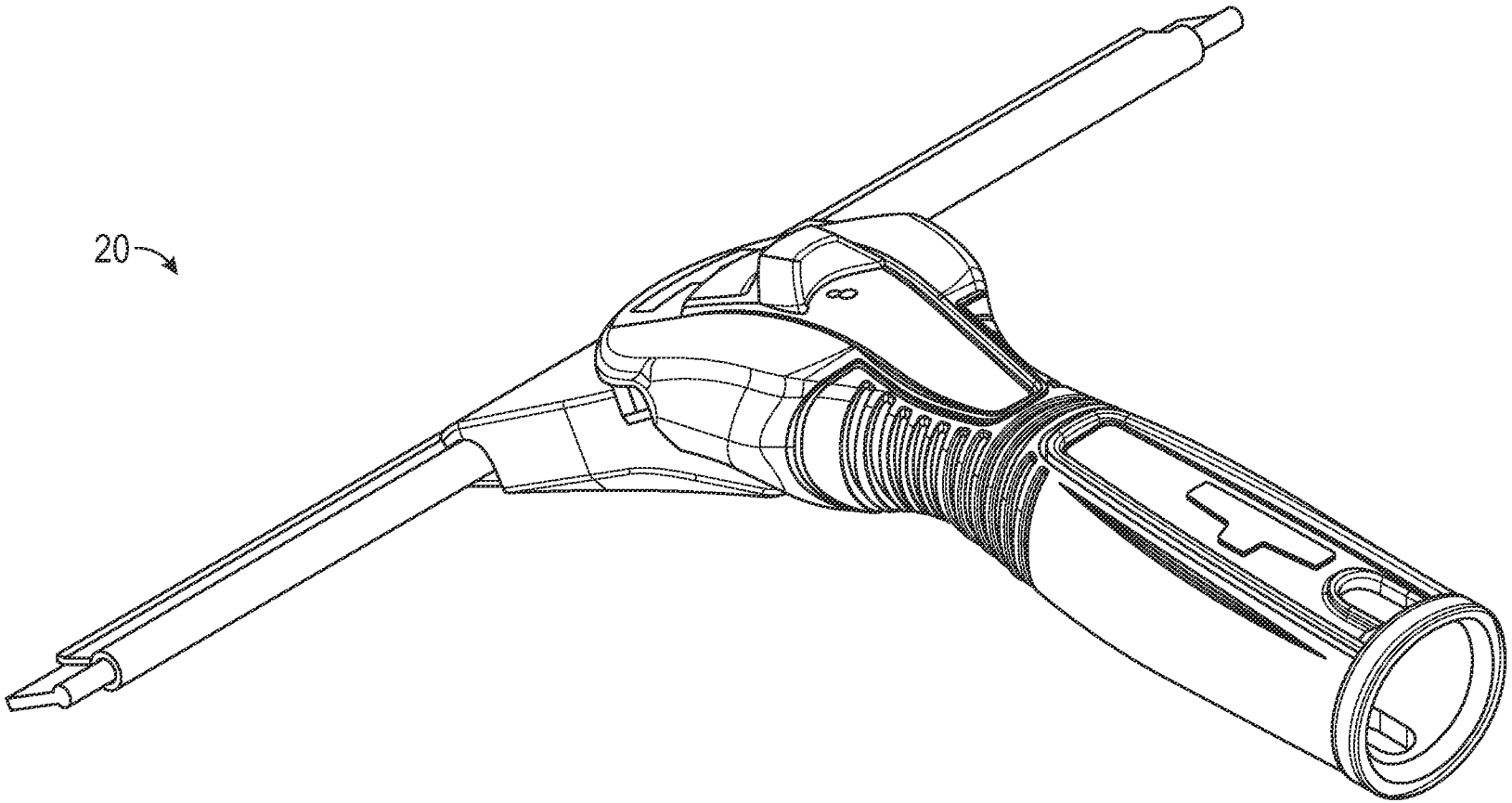
FIG. 10 is a perspective view of a surface cleaning tool according to an embodiment.
Figure 12:
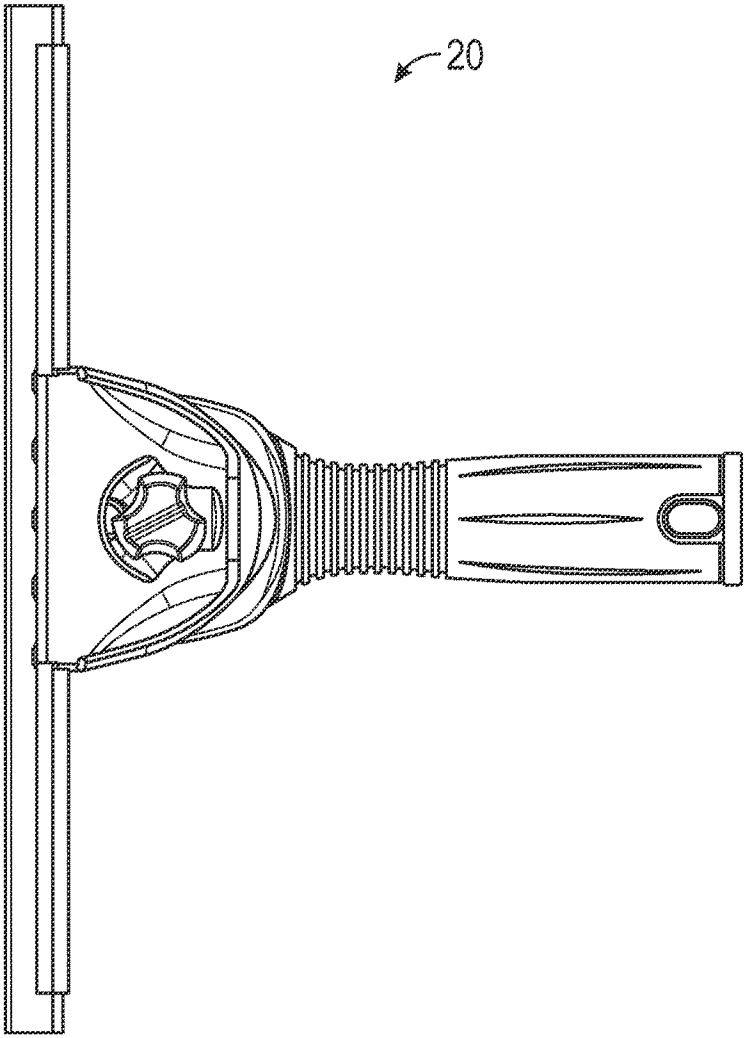
FIG. 12 is a bottom view of the surface cleaning tool of FIG. 10 according to an embodiment.
Figure 11:
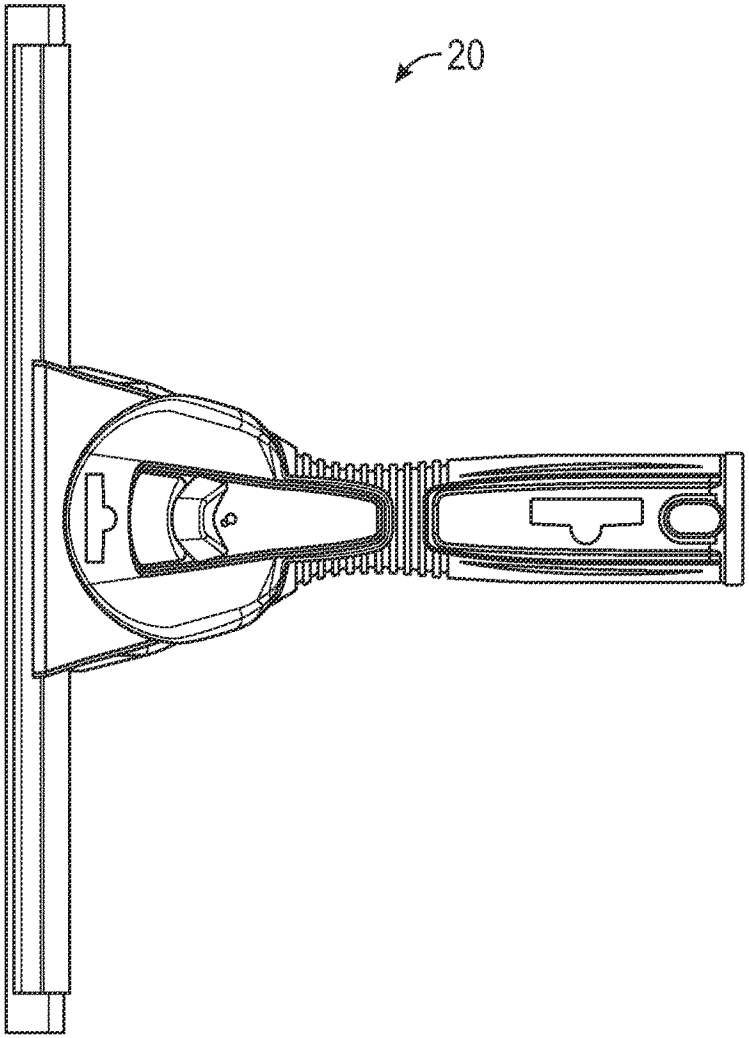
FIG. 11 is a top view of the surface cleaning tool of FIG. 10 according to an embodiment.
Figure 13:
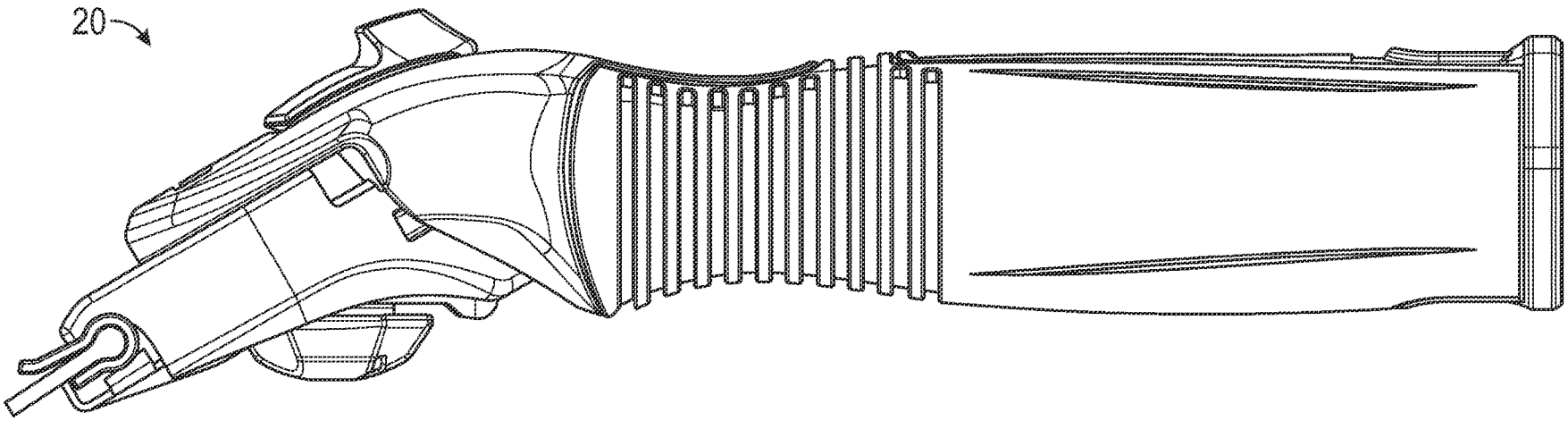
FIG. 13 is a first side view of the surface cleaning tool of FIG. 10 according to an embodiment.
Figure 14:
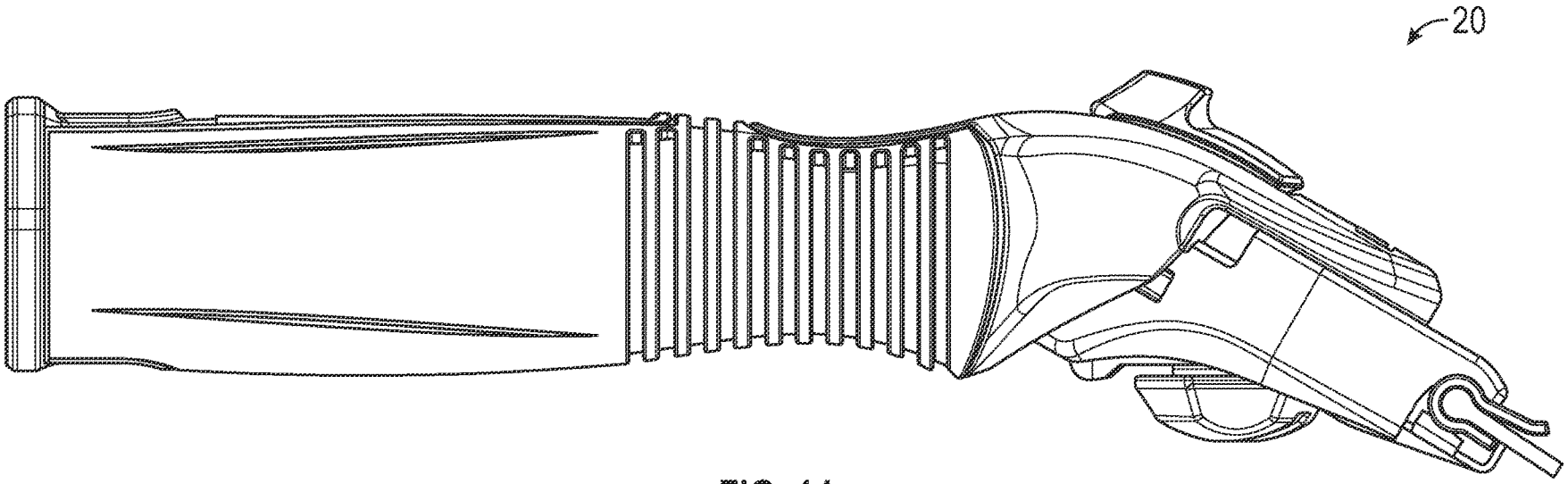
FIG. 14 is a second side view of the surface cleaning tool of FIG. 10 according to an embodiment.
Figure 15:
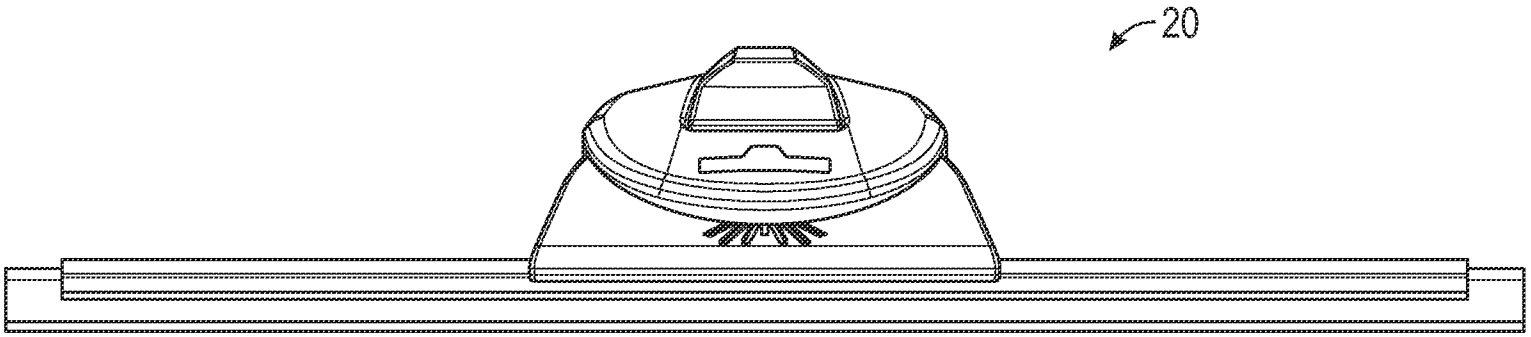
FIG. 15 is front view of the surface cleaning tool of FIG. 10 according to an embodiment.
Figure 16:
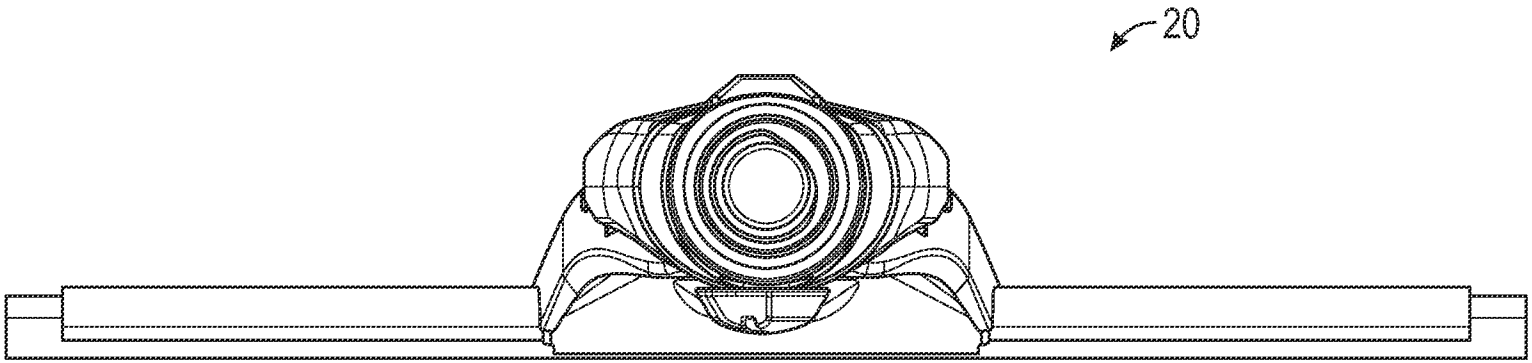
FIG. 16 is a back view of the surface cleaning tool of FIG. 10 according to an embodiment.

The handle assembly 22 additionally includes a locking mechanism 90 operable to selectively lock or retain the head 32 in one of the plurality of positions along the path of movement. As shown in FIGS. 7A and 7B, in the illustrated, non-limiting embodiment, the head 32 includes at least one, and in some embodiments, a plurality of protrusions 92 extending from an upper surface 94 of the upper housing 60. The protrusions 92 may, but need not be arranged near the back side 76. The plurality of protrusions 92 are spaced about the periphery of the back side 76 to form a slot 96 between each pair of adjacent protrusions 92. Each slot 96 may be associated with a different position of the plurality of positions. Accordingly, in an embodiment, the plurality of slots 96 represent when the longitudinal axis H of the head 32 is arranged at 45°, 30°, 15°, 0°, −15°, −30°, and −45° relative to the longitudinal axis X of the handle portion 34, respectively.

An engagement mechanism 98 is movably mounted to the handle body 30, such as to the connector portion 38 for example. Although the engagement mechanism 98 is illustrated as being translatable between a first unlocked position and a second locked position, it should be understood that embodiments where the engagement mechanism 98 is configured to move in another manner, such as rotate relative to the handle body 30 for example, are also within the scope of the disclosure In the illustrated, non-limiting embodiment, the engagement mechanism 98 includes a user portion 100 arranged at a first side of the connector portion 38. A user may apply force to the user portion 100 to transform the engagement mechanism 98 between the unlocked and locked positions.

The engagement mechanism 98 additionally includes one or more engagement features 102 arranged at a second side of the connector portion 38, adjacent to the surface of the upper housing 60. In the illustrated, non-limiting embodiment, the at least one engagement feature 102 includes a tooth or other protrusion. The engagement feature 102 is sized for receipt within each of the plurality of slot 96. When the engagement mechanism 98 is in the unlocked position, the engagement feature 102 is separated or remote from the slots 96 and the protrusions 92. In an embodiment, the engagement feature 102 is positioned in overlapping arrangement with the upper housing 60, such as at a position forward of the slots 96. In this position, the head 32 is freely rotatable about axis R. Once rotated about axis R to a desired position, a user applies a force to user portion 100 of the engagement mechanism 98 to move the engagement mechanism 98 to the locked position. In the locked position, at least a portion of the engagement feature 102 is arranged within a corresponding slot 96, abutting the adjacent protrusions 92. The interference or contact between the engagement feature 102 and the adjacent protrusions 92 restricts movement of the head 32 about the axis R in a first direction and a second, opposite direction. It should be understood that the locking mechanism 90 illustrated and described herein is intended as an example only and that embodiments including another type of locking mechanism operable to selectively lock the head 32 at various positions rotated about axis R relative to the handle body 30 are within the scope of the disclosure.

A surface cleaning tool 20 as illustrated and described herein provides enhanced operation by allowing for adjustment of the position of the head and wiper blade 24 relative to the handle body 30.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A surface cleaning tool comprising:

a handle body defining a first longitudinal axis and a tab protruding from the handle body at least partially along the first longitudinal axis; and a head configured to receive a wiper blade, the head defining a groove configured to receive the tab, the groove being elongated along a curved path of the head, the head defining a plane extending through a center of the head parallel to the wiper blade, wherein the head is rotatable along a path of movement relative to the handle body between at least a first position and a second position, and an orientation of the plane extending through the center of the head remains constant relative to the first longitudinal axis as the head rotates between at least the first position and the second position, and wherein during rotation of the head along the path of movement, the tab correspondingly remains within the groove, the tab being positioned adjacent to a first side of the groove when the head is in the first position and the tab being positioned adjacent to a second side of the groove when the head is in the second position.

2. The surface cleaning tool of claim 1, wherein the head is positionable at a plurality of positions relative to the handle body.

3. The surface cleaning tool of claim 2, wherein the the head defines a second longitudinal axis parallel with the plane and perpendicular to the wiper blade, wherein in the first position, the second longitudinal axis is arranged at a first angle relative to the first longitudinal axis, and in the second position, the second longitudinal axis is arranged at a second angle relative to the first longitudinal axis.

4. The surface cleaning tool of claim 3, wherein the first angle is equal and opposite to the second angle.

5. The surface cleaning tool of claim 3, wherein at least one position of the plurality of positions is located between the first position and the second position along the path of movement.

6. The surface cleaning tool of claim 3, wherein the plurality of positions includes a third position where the second longitudinal axis is aligned with the first longitudinal axis.

7. The surface cleaning tool of claim 2, further comprising a locking mechanism operable to retain the head in one of the plurality of positions.

8. The surface cleaning tool of claim 7, wherein the locking mechanism further comprises an engagement mechanism movable between an unlocked position and a locked position, the head being movable between the plurality of positions when the engagement mechanism is in the unlocked position, and the head being restricted from moving between the plurality of positions when the engagement mechanism is in the locked position.

9. The surface cleaning tool of claim 8, wherein the head further comprises a plurality of slots and in the locked position, a portion of the engagement mechanism is positionable within one of the plurality of slots.

10. A surface cleaning tool comprising:

a handle body having a tab extending therefrom;

a head connected to the handle body and configured to receive a wiper blade, the head being movable along a path of movement between at least a first position and a second position relative to the handle body, wherein the head further comprises a plurality of protrusions and a plurality of slots formed between the plurality of protrusions, and wherein the head further defines a groove configured to receive the tab, the groove being elongated along a curved path of the head; and a locking mechanism operable to selectively lock the head relative to the handle body, the locking mechanism comprising an engagement mechanism having an engagement feature positioned adjacent to a surface of the head, the engagement feature being receivable within one of the plurality of slots to restrict movement of the head along the path of movement, wherein during movement of the head along the path of movement, the tab remains within the groove, the tab being positioned adjacent to a first side of the groove when the head is in the first position and the tab being positioned adjacent to a second side of the groove when the head is in the second position.

11. The surface cleaning tool of claim 10, wherein the engagement mechanism is manually movable to selectively lock the head relative to the handle body.

12. The surface cleaning tool of claim 11, wherein the head is movable within a plane oriented parallel to the wiper blade and including a longitudinal axis of the head.

13. The surface cleaning tool of claim 12, wherein the plane is arranged at an angle to a longitudinal axis of the handle body.

14. The surface cleaning tool of claim 12, wherein the longitudinal axis of the head is coplanar with a longitudinal axis of the handle body.

15. The surface cleaning tool of claim 12, wherein the head is rotatable about an axis along the path of movement.

16. The surface cleaning tool of claim 15, wherein the axis is arranged at an angle to a longitudinal axis of the handle body.

17. The surface cleaning tool of claim 10, wherein the engagement mechanism is translatable between an unlocked position and a locked position, the engagement feature being receivable within one of the plurality of slots in the locked position.

18. The surface cleaning tool of claim 10, wherein each of the plurality of slots is associated with a different position of the head along the path of movement.

* * * * *